US010399810B2

(12) United States Patent
Agata

(10) Patent No.: US 10,399,810 B2
(45) Date of Patent: Sep. 3, 2019

(54) SHEET DISCHARGING APPARATUS AND IMAGE FORMING APPARATUS

(71) Applicant: CANON KABUSHIKI KAISHA, Tokyo (JP)

(72) Inventor: Jun Agata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 15/297,936

(22) Filed: Oct. 19, 2016

(65) Prior Publication Data

US 2017/0107071 A1 Apr. 20, 2017

(30) Foreign Application Priority Data

Oct. 20, 2015 (JP) ..... 2015-206278

(51) Int. Cl.

| | |
|---|---|
| ***B65H 29/70*** | (2006.01) |
| ***B65H 31/02*** | (2006.01) |
| ***G03G 15/00*** | (2006.01) |
| ***B65H 29/14*** | (2006.01) |
| ***B65H 43/06*** | (2006.01) |

(52) U.S. Cl.

CPC ..... *B65H 29/70* (2013.01); *B65H 29/14* (2013.01); *B65H 31/02* (2013.01); *B65H 43/06* (2013.01); *G03G 15/6529* (2013.01); *G03G 15/6552* (2013.01); *B65H 2301/4212* (2013.01); *B65H 2301/5122* (2013.01); *B65H 2404/143* (2013.01); *B65H 2404/144* (2013.01); *B65H 2404/61* (2013.01); *B65H 2404/63* (2013.01); *B65H 2405/11151* (2013.01); *B65H 2553/612* (2013.01); *B65H 2601/522* (2013.01); *B65H 2801/06* (2013.01)

(58) Field of Classification Search

CPC ..... B65H 29/12; B65H 29/14; B65H 29/20; B65H 29/22; B65H 29/70; B65H 2404/63; B65H 2404/65

USPC ..... 271/209, 220

See application file for complete search history.

(56) References Cited

U.S. PATENT DOCUMENTS

2006/0237900 A1* 10/2006 Sekiyama ..... B65H 29/14 271/220
2007/0025796 A1* 2/2007 James, III ..... B41J 13/076 400/637.3

(Continued)

FOREIGN PATENT DOCUMENTS

| | | |
|---|---|---|
| JP | 2003-48644 A | 2/2003 |
| JP | 4065506 B2 | 3/2008 |
| JP | 5173527 B2 | 4/2013 |

*Primary Examiner* — Prasad V Gokhale

(74) *Attorney, Agent, or Firm* — Canon U.S.A., Inc. IP Division

(57) ABSTRACT

A sheet discharging apparatus configured to discharge a sheet includes a discharging portion, a contact member, and a detector. The discharging portion discharges a sheet so as to be bent in a curved shape in a width direction of the sheet, perpendicular to a discharging direction of the sheet when viewed in a sheet discharging direction. The contact member is moved by contact with the sheet discharged by the discharging portion, wherein the contact member includes a contact surface to be in contact with the sheet which is inclined along the curved shape of the sheet in the width direction of the sheet when viewed in the sheet discharging direction. The detector detects a discharging of the sheet based on the movement of the contact member.

10 Claims, 10 Drawing Sheets

(56) References Cited

U.S. PATENT DOCUMENTS

| | | | | |
|---|---|---|---|---|
| 2009/0189344 | A1* | 7/2009 | Suzuki | B65H 29/52<br>271/314 |
| 2009/0295061 | A1* | 12/2009 | Honda | B41J 13/0036<br>271/3.14 |
| 2009/0295083 | A1* | 12/2009 | Kitan | B65H 29/70<br>271/306 |
| 2010/0278576 | A1* | 11/2010 | Suzuki | B65H 29/22<br>399/405 |
| 2012/0112402 | A1* | 5/2012 | Onishi | G03G 15/6552<br>271/109 |
| 2014/0029998 | A1* | 1/2014 | Takemoto | B65H 29/14<br>399/405 |
| 2014/0239578 | A1* | 8/2014 | Honda | B65H 43/06<br>271/217 |

* cited by examiner

SHEET DISCHARGING APPARATUS AND IMAGE FORMING APPARATUS

BACKGROUND OF THE INVENTION

Field of the Invention

The present invention relates to a sheet discharging apparatus configured to discharge sheets and an image forming apparatus including the sheet discharging apparatus, such as a printer and a copier.

Description of the Related Art

A sheet discharging apparatus having the following configuration is known as an example of an apparatus configured to discharge a sheet from the apparatus body to a sheet stacked portion while bending the sheet in a wave form for stiffening. The sheet discharging apparatus includes a first roller including a first rotation shaft and at least one roller body and a second rotation roller including a second rotation shaft and at least two roller bodies. The second rotation shaft is rotatably supported at a position away from the first rotation shaft with a predetermined distance therebetween. The roller body of the first roller is located between two roller bodies of the second roller so that the roller bodies of the first and second rollers are alternately positioned in a comb like arrangement (Japanese Patent No. 5173527). The roller bodies of the first and second rollers are each rotatably supported by the corresponding rotation shaft while the rotational center thereof is fixed. With this configuration, the sheet is bent into a wave form in accordance with the comb like arrangement of the roller bodies while being discharged from the apparatus body. This improves the strength of the sheet and enables the discharging angle of the sheet to be maintained during the discharging. Thus, the sheet is prevented from coming in contact with the sheet on the sheet stacked portion during the discharging, enabling the discharged sheet to be properly positioned on the sheet stacked portion and preventing a sheet on the sheet stacked portion from moving out of the sheet stacked portion, for example. Thus, the sheet is reliably stacked on the sheet stacked portion.

The above-described comb like roller in which roller bodies are positioned in the comb like arrangement may include a discharging detection sensor unit and a sensor for detecting a height of a stack of sheets. Japanese Patent No. 4065506 and Japanese Patent Laid-Open No. 2003-48644 each describe an image forming apparatus having the following configuration as an example of the apparatus including the discharging detection sensor unit and the sensor for detecting a sheet surface height.

The image forming apparatus described in Japanese Patent No. 4065506 includes a full stack detection flag movable about a rotary shaft located above a discharging port through which a sheet is discharged. The full stack detection flag is hanging down over the discharging port. The full stack detection flag is turnable so as to move among a first position, a third position, and a second position located between the first position and the third position. The full stack detection flag is positioned at the first position before the sheet is discharged. The full stack detection flag is positioned at the third position when the sheet moves up the full stack detection flag above the discharging portion. The full stack detection flag at the second position determines the height of a stack of sheets to determine the stacked state of the sheets. In addition, the full stack detection flag is configured such that positions of the front end of the full stack detection flag and the rear end of the sheet are not inverted in the direction of gravitational force when the full stack detection flag at the third position turns to fall toward the second and first positions after the rear end of the sheet passed through the discharging port. Specifically, the image forming apparatus includes a one-way friction pad, which delays the turn and falling of the full stack detection flag.

In addition, the image forming apparatus described in Japanese Patent Laid-Open No. 2003-48644 includes a sheet stacked portion, which receives a sheet on which an image was formed, and a full stack detection flag configured to determine the height of a stack of sheets on the sheet stacked portion. The full stack detection flag includes a plurality of detection levers arranged in a width direction perpendicular to a sheet discharging direction. A detection lever in contact with a lateral end of the sheet detects the height of a stack of sheets at a lower position than a detection lever in contact with a middle portion of the sheet.

The full stack detection flag and the detection lever as sensor flags, which are described in Japanese Patent No. 4065506 and Japanese Patent Laid-Open No. 2003-48644, are each flat at a portion in contact with the sheet when viewed in a cross-sectional view taken along a plane perpendicular to the rotary shaft of the sensor flag.

In the sheet discharging apparatus described in Japanese Patent No. 4065506 and Japanese Patent Laid-Open No. 2003-48644, a contact member of a detection unit, which is configured to detect the sheet discharged from the sheet discharging apparatus while being bent in the wave form for stiffening, does not uniformly come in contact with the sheet in the wave form. Thus, a load tends to concentrate on a portion of the detection unit in contact with the sheet. In particular, in the apparatus described in Japanese Patent No. 4065506 including a plurality of contact flags across the width of the sheet, a load, concentrates on one or more of the contact flags at the end in the width of the sheet, and local wear may occur at the contact flag (s). The apparatus described in Japanese Patent Laid-Open No. 2003-48644 has the same problem. In addition, various kinds of sheets passed through the sheet discharging apparatus may unevenly wear the contact flags, resulting in abnormal wear, which forms a V-shaped notch or a step.

The abnormal wear may cause a sheet, particularly a thin sheet having a low basis weight to be damaged at the discharging port or to be jammed (paper jam) due to oblique movement, resulting in improper stacked. To solve the problems, the detection unit may be formed of a material having high wearing resistance or a high polymer sheet having lower friction coefficient may be attached to the detection unit. However, this leads to an increase in the cost of the apparatus.

SUMMARY OF THE INVENTION

An aspect of the present invention provides a sheet discharging apparatus including a contact member subjected to less abnormal wear and an image forming apparatus including the sheet discharging apparatus.

According to an aspect of the present invention, a sheet discharging apparatus configured to discharge a sheet includes a discharging portion configured to discharge a sheet so as to be bent in a curved shape in a width direction of the sheet, perpendicular to a discharging direction of the sheet when viewed in a sheet discharging direction, a contact member configured to be moved, by contact with the sheet discharged by the discharging portion, wherein the contact member includes a contact surface to be in contact with the sheet which is inclined along the curved shape of the sheet in the width direction of the sheet when viewed in the sheet discharging direction, and a detector configured to detect a discharging of the sheet based on the movement of the contact member.

Further features of the present invention will become apparent from the following description of exemplary embodiments with reference to the attached drawings.

DESCRIPTION OF THE EMBODIMENTS

First Embodiment

Figure 1:
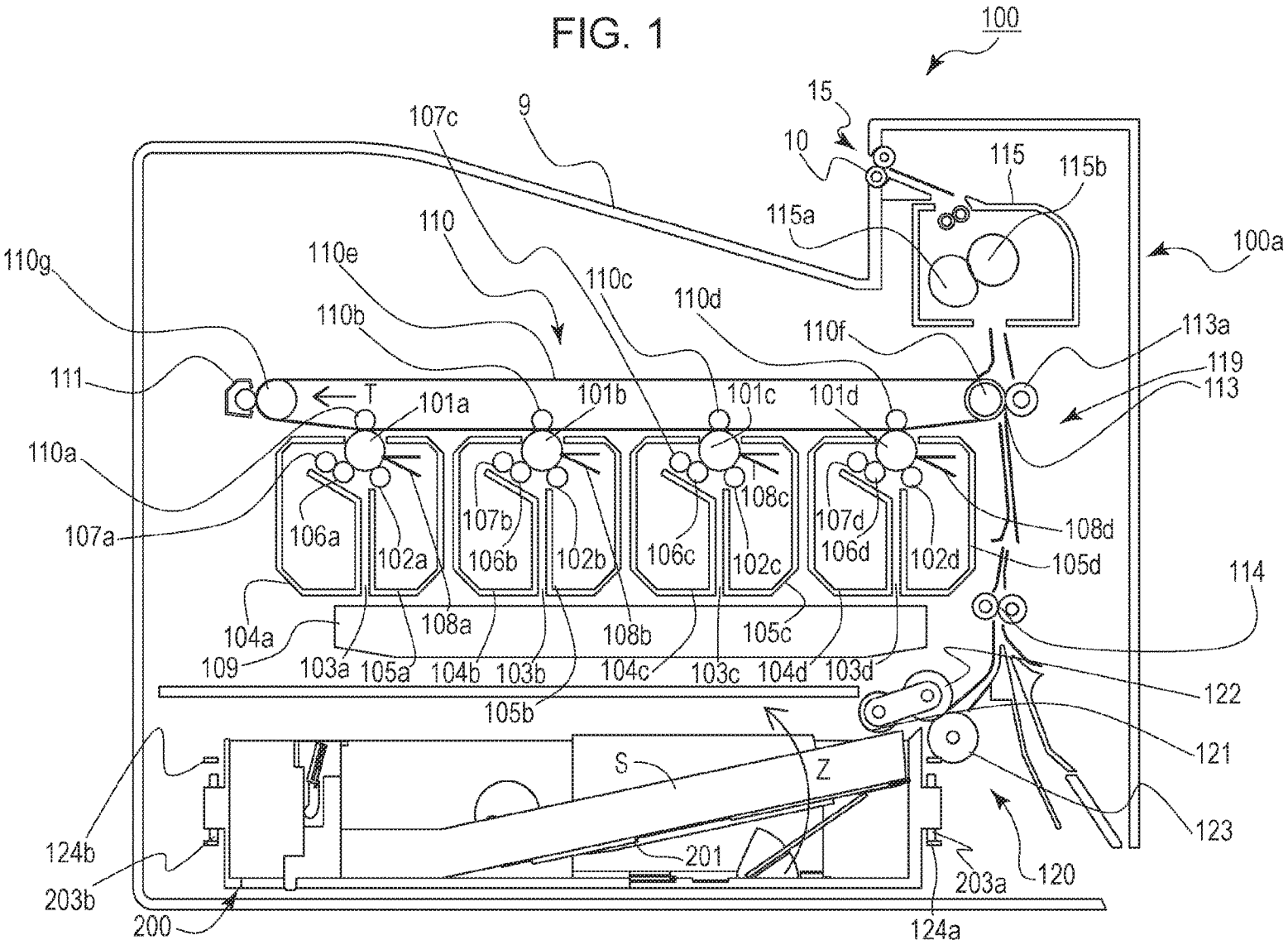
FIG. 1 is a schematic cross-sectional view illustrating an image forming apparatus according to a first embodiment of the present invention.

Hereinafter, a sheet discharging apparatus and an image forming apparatus according to an embodiment of the present invention are described with reference to the drawings. An image forming apparatus 100 according to the present embodiment may be a copier using an electrophotography process or an electrostatic recording process, a facsimile, a printer, or a multifunction apparatus including functions of a copier, a facsimile, and a printer, for example. The image forming apparatus 100 includes a sheet discharging apparatus configured to discharge sheets onto a sheet stacked portion. FIG. 1 is a schematic cross-sectional view illustrating the image forming apparatus 100 according to a first embodiment.

Image Forming Apparatus

As illustrated in FIG. 1, the image forming apparatus 100 includes an apparatus body 100*a*. Process cartridges 103*a*, 103*b*, 103*c*, and 103*d* are detachably attached to the apparatus body 100*a*. The process cartridges 103*a* to 103*d* have the identical configuration, but have toners of different colors, i.e., yellow (Y), magenta (M), cyan (C), and black (Bk), for forming an image.

The process cartridges 103*a* to 103*d* include developing units 104*a*, 104*b*, 104*c*, and 104*d*, respectively, and cleaner units 105*a*, 105*b*, 105*c*, and 105*d*, respectively. The developing units 104*a* to 104*d* include developer rollers 106*a*, 106*b*, 106*c*, and 106*d*, respectively, developing material application rollers 107*a*, 107*b*, 107*c*, and 107*d*, respectively, and toner containers. The cleaner units 105*a* to 105*d* include photosensitive drums 101*a*, 101*b*, 101*c*, and 101*d*, respectively, and charging rollers 102*a*, 102*b*, 102*c*, and 102*d*, respectively. The cleaner units 105*a* to 105*d* further include drum cleaning blades 108*a*, 108*b*, 108*c*, and 108*d*, respectively, and residual toner containers.

A scanner unit 109 is disposed below the process cartridges 103*a* to 103*d*. The scanner unit 109 is configured to expose the photosensitive drums 101*a* to 101*d* to light based on image signals. The photosensitive drums 101*a* to 101*d* are negatively charged by the charging rollers 102*a* to 102*d* to predetermined potentials. Then, the scanner unit 109 forms electrostatic latent images on the photosensitive drums 101*a* to 101*d*. The electrostatic latent images are reversely developed by the developing units 104*a* to 104*d* and negatively charged toner is attached to the electrostatic latent images, and thus toner images in colors of Y, M, C, and Bk are formed on the photosensitive drums 101*a* to 101*d*.

An intermediate transfer belt unit 110 includes a drive roller 110*f*, a tension roller 110*g*, and an intermediate transfer belt 110*e* wound around the drive roller 110*f* and the tension roller 110*g* in a tensioned state. The tension roller 110*g* applies tension to the intermediate transfer belt 110*e* in a direction indicated by the arrow T. In addition, primary transfer rollers 110*a*, 110*b*, 110*c*, and 110*d* are disposed on an inner side of the intermediate transfer belt 110*e* so as to face the respective photosensitive drums 101*a* to 101*d*. A transfer bias is applied to the primary transfer rollers 110*a* to 110*d* by a bias applicator, which is not illustrated.

The photosensitive drums 101*a* to 101*d* are rotated in a clockwise direction in FIG. 1, and the intermediate transfer belt 110*e* is rotated in a counterclockwise direction. In addition, a positive bias is applied to the primary transfer rollers 110*a* to 110*d*. This enables the toner images on the photosensitive drums 101*a* to 101*d* to be primary transferred onto the intermediate transfer belt 110*e* in sequence from the toner image on the photosensitive drum 101*a*. The overlapped toner images in four colors are delivered to a secondary transfer portion 113. The process cartridges 103*a* to 103*d*, the intermediate transfer belt unit 110, and the secondary transfer portion 113, for example, constitute an image forming unit 119 configured to form an image on a sheet S delivered to the image forming unit 119.

After the toner image is transferred to the intermediate transfer belt 110*e*, the residual toner on the photosensitive drums 101*a* to 101*d* is removed by the drum cleaning blades 108*a* to 108*d* and collected in the residual toner containers. The residual toner on the intermediate transfer belt 110*e* after the secondary transfer to the sheet S is removed by a transfer belt cleaning unit 111. The removed toner is sent to a residual toner collecting container not illustrated), which is disposed on a rear side of the apparatus, through a residual toner path (not illustrated).

A sheet feeding portion 120 includes a feeding roller 121, a feed roller 122, and a retard roller 123, which are mounted in the apparatus body 100*a*, and a paper cassette 200, which is detachably mounted in the apparatus body 100*a*. The sheet S fed one by one from the sheet feeding portion. 120 is delivered to a pair of registration rollers 114. The paper cassette 200 is detachable in a direction toward the front in FIG. 1 (front side of the image forming apparatus 100 adjacent to the operator), i.e., in a width direction, which is perpendicular to a delivery direction of the sheet S.

The sheet S is delivered to the secondary transfer portion 113 by the pair of registration rollers 114. At the secondary transfer portion 113, a positive bias is applied to a secondary transfer roller 113*a*. This enables the toner images in four colors on the intermediate transfer belt 110*e* to be secondary transferred onto the sheet S arrived at the secondary transfer portion 113. The sheet S having the transferred toner images are delivered to a fixing unit. 115 and heated under pressure by a fixing roller 115*a* and a pressure roller 115*b*, and thus the toner images are fixed on the surface of the sheet S. The sheet C is delivered to a pair of discharging rollers 10 of a sheet discharging portion 15 and discharged onto the sheet stacked portion 9, which is a stacked portion.

The pair of discharging rollers 10 constitutes an discharging portion configured to discharge a sheet S from the apparatus body 100*a* while bending the sheet S in a wave form in the width direction (indicated by the arrow I in FIG. 2), which is perpendicular to a sheet discharging direction (indicated by the arrow H in FIG. 2) for stiffening. The sheet stacked portion 9 is a stacked portion on which the sheet S discharged by the pair of discharging rollers (discharging portion) 10 is stacked. The sheet discharging portion 15 constitutes a sheet discharging apparatus configured to discharge a sheet after an image is formed on the sheet by the image forming unit 119.

Sheet Discharging Portion

Figure 2:
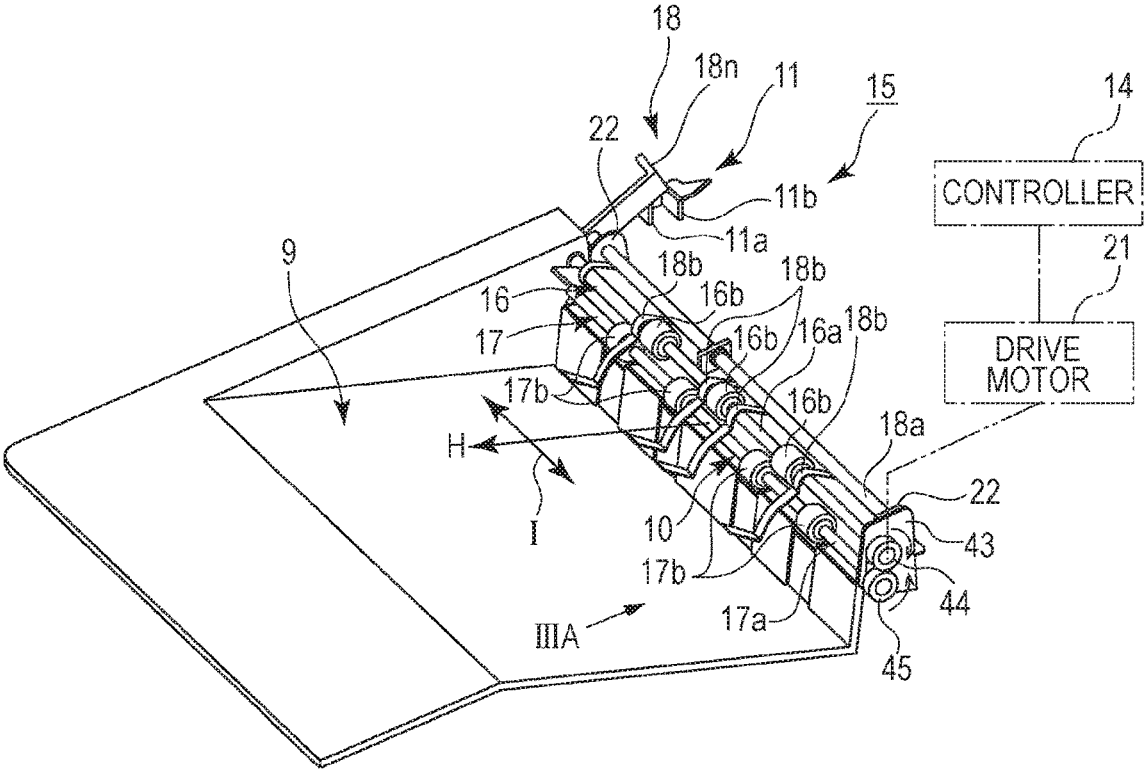
FIG. 2 is a perspective view illustrating a sheet discharging portion according to the first embodiment.
Figure 3A:
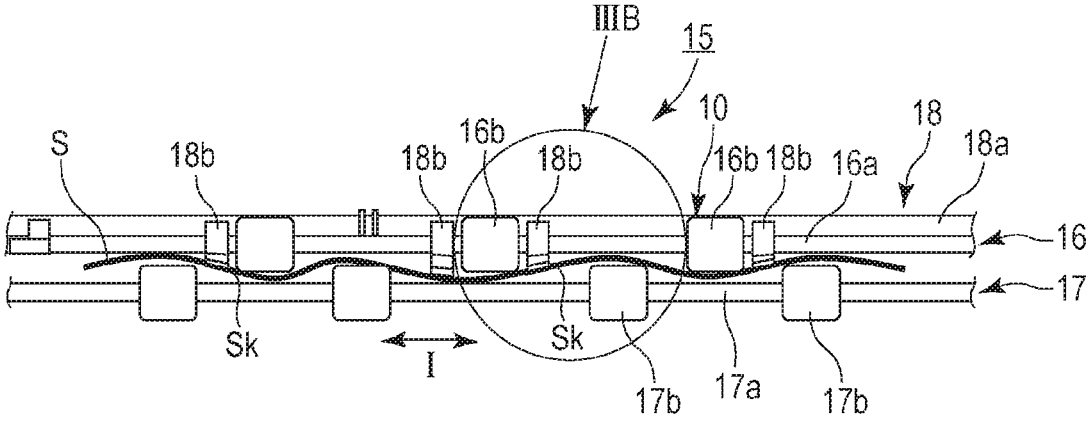
FIG. 3A is a view illustrating an overall configuration of the sheet discharging portion viewed in a direction indicated by die arrow IIIA in FIG. 2.
Figure 3B:
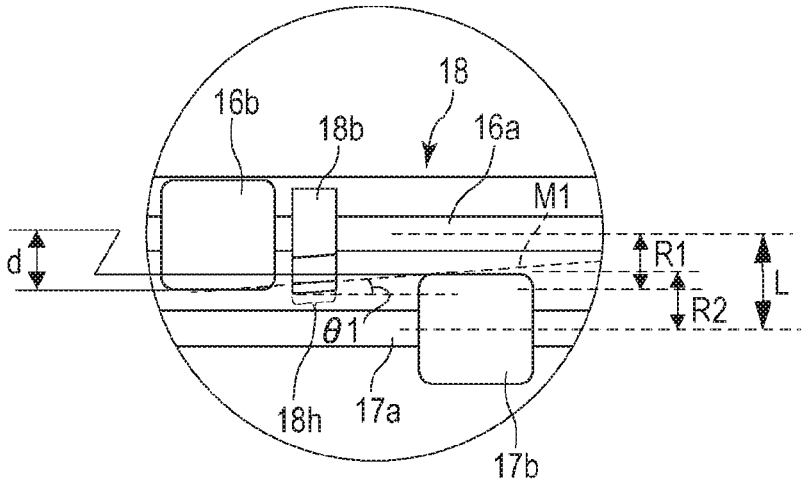
FIG. 3B is a magnified view of a portion encircled in FIG. 3A.

Next, the sheet discharging portion 15, which is the sheet discharging apparatus according to the present embodiment, is described in detail with reference to FIG. 2 to FIGS. 3A and 3B. FIG. 2 is a perspective view illustrating the sheet discharging portion 15 according to the present embodiment. FIG. 3A is a view illustrating the overall configuration of the sheet discharging portion 15 viewed in a direction indicated by the arrow IIIA in FIG. 2. FIG. 3B is a magnified view of a portion encircled in FIG. 3A.

The sheet discharging portion 15 includes the pair of discharging rollers (discharging portion) 10 configured to discharge a sheet from the apparatus body 100*a*. The sheet discharging portion 15 includes an upper discharging roller 16 and a lower discharging roller 17. An discharging detection sensor unit 18 including a plurality of contact flags (contact members) 18*b* configured to detect that the sheet is discharged from the apparatus by the pair of discharging rollers 10 is disposed near the pair of discharging rollers 10. The plurality of contact flags 18*b* are configured to determine the discharging situation of the sheet discharged by the pair of discharging rollers 10 and whether the stacked sheets on the sheet stacked portion 9 reach the stack limit.

The discharged sheet is stacked on the sheet stacked portion 9 in sequence and, when the number of the stacked sheets reaches a predetermined number, an upper surface of the uppermost sheet on the sheet stacked portion 9 sways the contact flag 18*b* of the discharging detection sensor unit 18. In this case, the discharging detection sensor unit 18 functions as a limit detector, which determines whether the stacked sheets on the sheet stacked portion reach the stack limit. The upper discharging roller 16 and the lower discharging roller 17 are each rotatably attached to a transportation guide 43 by a bearing, which is not illustrated.

A rotational force generated by a drive motor (drive source) 21, which is controlled by a controller 14, is transferred to the upper discharging roller 16 as a rotational force for discharging the sheet S onto the sheet stacked portion 9. The rotational force transferred to the upper discharging roller 16 is transferred to the lower discharging roller 17 by engagement of integrally fixed gears 41 and 45. The upper discharging roller 16 and the lower discharging roller 17 of the pair of discharging rollers 10 are rotated in respective directions indicated by arrows in FIG. 2 upon reception of the rotational force transferred from the drive motor 21 during the operation of the image forming apparatus 100.

As illustrated in FIG. 2 and FIG. 3A, the upper discharging roller 16 includes a first rotation shaft 16*a* and a plurality of first discharging roller bodies 16*b* fixed to the first rotation shaft 16*a*. The lower discharging roller 17 includes a second rotation shaft 17*a* and a plurality of second discharging roller bodies 17*b* fixed to the second rotation shaft 17*a*. The first and second discharging roller bodies 16*b* and 17*b* are arranged alternately in a comb like arrangement with a predetermined distance therebetween and do not form a nip portion. In other words, the first discharging roller bodies 16*b* and the second discharging roller bodies 17*b* are arranged alternately in the width direction (indicated by the arrow I), which is perpendicular to the sheet discharging direction (indicated by the arrow H), and are arranged in the vertical direction so as to face the upper surface and the rear surface of the sheet S to be discharged by the pair of discharging rollers 10. The second discharging roller bodies 17*b* are disposed on an opposite side of the sheet S, which is discharged from the apparatus, from the first discharging roller bodies 16*b* and are positioned away from the first discharging roller bodies 16*b* in the direction along the rotational axis of the first discharging roller bodies 16*b*.

As illustrated in FIG. 3B, the pair of discharging rollers 10 includes at least one first discharging roller body 16*b* supported coaxially by the first rotation shaft 16*a* and at least one second discharging roller body 17*b* supported coaxially by the second rotation shaft 17*a* such that the first and second discharging roller bodies 16*b* and 17*b* are arranged alternately in the width direction. The first discharging roller body 16*b* and the second discharging roller body 17*b* face the front surface and the rear surface of the sheet to be discharged, respectively. The distance between the first rotation shaft 16*a* and the second rotation shaft 17*a* is defined as L, the radius of the first discharging roller body 16*b* is defined as R1, and the radius of the second discharging roller body 17*b* is defined as R2. The distance L between the first and second rotation shafts 16*a* and 17*a* satisfies $L<R1+R2$.

In this configuration, outer peripheral portions of the first and second discharging roller bodies 16*b* and 17*b* are overlapped by a distance d. Specifically, the outer peripheral portion of the first discharging roller body 16*b* and the outer peripheral portion of the second discharging roller body 17*b* are overlapped with each other in a direction perpendicular to both the sheet discharging direction and the axial direction of the first discharging roller body 16*b*. The sheet S passing through the nip portion between the pair of discharging rollers 10 is bent along the arrangement of the first and second discharging roller bodies 16*b* and 17*b* for stiffening and the sheet S in the wave form illustrated in FIG. 3A is discharged. In other words, the sheet S is discharged from the apparatus while being bent in the wave form for stiffening in the width direction (indicated by the arrow I), which is perpendicular to the sheet discharging direction (indicated by the arrow H).

Discharging Detection Sensor Unit and Peripheral Portions

Next, configurations of the discharging detection sensor unit 18 and the peripheral portions are described in detail with reference to FIGS. 3A and 3B.

As illustrated in FIG. 3A, the discharging detection sensor unit 18 includes a discharging detection sensor unit shaft 18*a* rotatably supported by bearings 22 (FIG. 2) at its ends. The discharging detection sensor unit 18 includes the discharging detection sensor unit shaft 18*a*, which extends between supported portions supported by the respective bearings 22, the plurality of contact flags 18*b*, which are configured to detect passage of the sheet and determine the height of the stacked sheets, and a light blocking flag 18*n* integrally formed on an end of the discharging detection sensor unit shaft 18*a*. The contact flags (contact members) 18*b* are rotatably supported by the apparatus body 100*a* and are configured to come in contact with the sheet S discharged by the pair of discharging rollers 10. At least one contact flag 18*b* (four contact flags 18*b* in this embodiment) is disposed in the width direction (indicated by the arrow I).

In addition, a photointerrupter (detector) 11 (FIG. 2) configured to detect rotation of the discharging detection sensor unit 18 is fixed at a portion of the apparatus body 100*a* facing the light blocking flag 18*n* (FIG. 2). The light blocking flag 18*n* is configured to move into and out of a space between a light emitting portion 11*a* (FIG. 2) and a light receiving portion 11*b* (FIG. 2) of the photointerrupter 11 such the state of the space between the light emitting portion 11*a* and the light receiving portion 11*b* is switched between a light blocking state and a light transmission state.

In FIG. 3B, a dashed straight line M1 connects an edge of the outer periphery of the first discharging roller body 16*b* and that of the second discharging roller body 17*b* when viewed in the sheet discharging direction. The contact flag 18*b* includes a sheet surface detection portion. 18*h*. The sheet surface detection portion 18*h*, which is an inclined guide surface of the present embodiment, extends substantially parallel to the straight line M1. Each of the other contact flags 18*b* also includes the sheet surface detection portion 18*h*, which is the inclined guide surface.

The sheet surface detection portion 18*h* as the inclined guide surface of the present embodiment is inclined at an angle θ1 so as to extend along the straight line M1 connecting the adjacent ends of the outer peripheral surfaces of the first and second discharging roller bodies 16*b* and 17*b* adjacent to each other in a space between the first and second rotation shafts 16*a* and 17*a*.

In other words, the contact flag 18*b* includes the sheet surface detection portion 18*h* as the inclined guide surface inclined at the angle corresponding to the wave form of a surface Sk (FIG. 3A) of the sheet S bent in the wave form in the width direction by the pair of discharging rollers (discharging portion) 10 for stiffening. The pair of discharging rollers 10 discharges the sheet S while bending the sheet in a curved form when viewed in the sheet discharging direction. The sheet surface detection portion 18*h* of the contact flag 18*b* in contact with the sheet S is inclined in the direction along the curved surface of the sheet S. The contact flag 18*b*, which is rotatably supported by the apparatus body 100*a* through the discharging detection sensor unit shaft (base portion) 18*a*, includes a free end portion 18*j* including the sheet surface detection portion (inclined guide surface) 18*h*. The free end portion 18*j* is configured to be in contact with the sheet S discharged by the pair of discharging rollers 10.

Operation of Sheet Discharging Portion

Figure 4C:
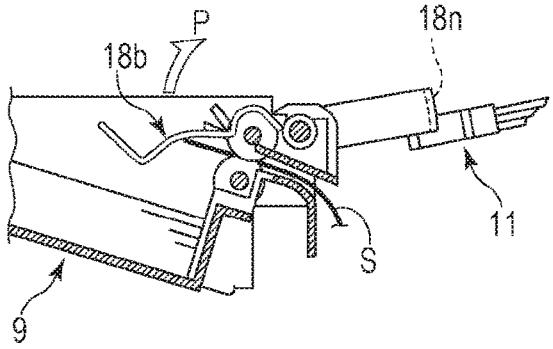
FIG. 4C is a motion diagram indicating a state in which a contact flag of the discharging detection sensor unit starts rotating.
Figure 4A:
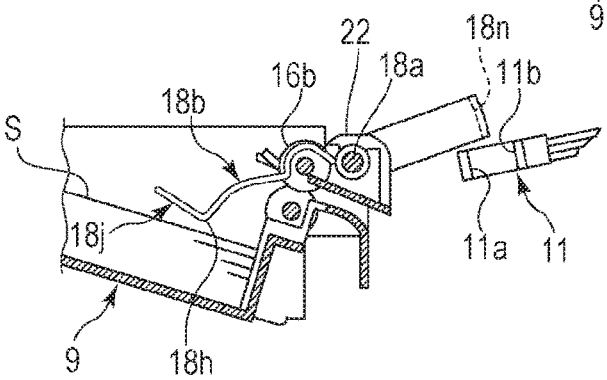
FIG. 4A is a motion diagram indicating a standby state before a sheet arrives at the sheet discharging portion.
Figure 4D:
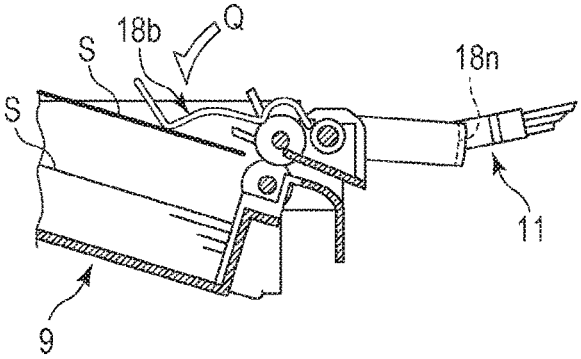
FIG. 4D is a motion diagram indicating a state in which a rear end of the sheet is discharged from the apparatus by the pair of discharging rollers.
Figure 4B:
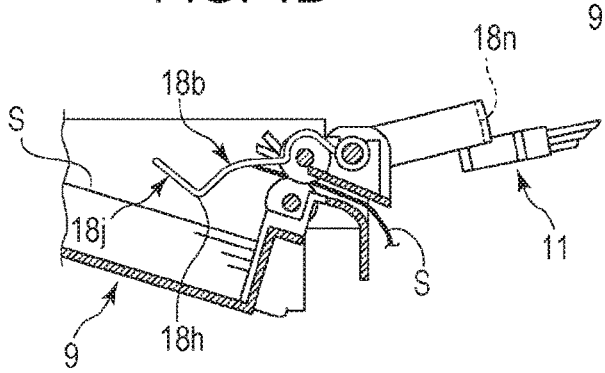
FIG. 4B is a motion diagram indicating a state in which the sheet discharged by a pair of discharging rollers arrives at a discharging detection sensor unit.
Figure 4E:
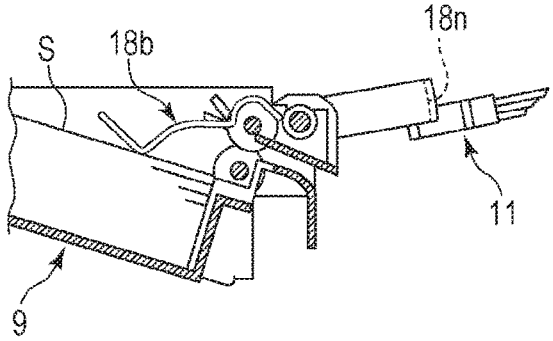
FIG. 4E is a motion diagram indicating a state in which sheets on a sheet stacked portion prevents the discharging detection sensor unit from returning to a standby state.

Next, the operation of the sheet discharging portion 15 is described. FIGS. 4A to 4E are motion diagrams illustrating how the sheet discharging portion 15 according to the present invention operates. FIG. 4A illustrates a standby state before a sheet arrives at the sheet discharging portion 15. FIG. 4B illustrates a state in which the sheet discharged by the pair of discharging rollers 10 arrives at the discharging detection sensor unit 18. FIG. 40 illustrates a state in which the contact flag 18*b* of the discharging detection sensor unit 18 starts rotating. FIG. 4D illustrates a state in which the rear end of the sheet is discharged by the pair of discharging rollers 10. FIG. 4E illustrates a state in which the sheets on the sheet stacked portion 9 prevent the discharging detection sensor unit 18 from returning to a standby state. In FIG. 4E, the sheet surface detection portion 18*h* in contact with an uppermost one of a stack of sheets S on the sheet stacked portion 9 extends substantially parallel to the upper surface of the stack of sheets S. The sheet surface detection portion 18*h* in contact with the sheet S is able to be in contact with the sheet S with almost no space.

As illustrated in FIG. 4A, when the sheet discharging portion 15 is in a standby state, the light blocking flag 18*n* is away from the photointerrupter 11, and the photointerrupter 11 is in the light transmission state. In the light transmission state, when the sheet S discharged by the pair of discharging rollers 10 arrives at the contact flag 18*b* of the discharging detection sensor unit. 18 (FIG. 4B), the front end of the sheet S comes in contacts with the sheet surface detection portion (tapered portion) 18*h* as the inclined guide surface.

The sheet S being discharged moves under the sheet surface detection portion 18*h* while being in contact with the sheet surface detection portion 18*h*. This turns the contact flag 18*b* in a direction indicated by the arrow P in FIG. 4C. Then, when the contact flag 18*b* is moved up by a predetermined angle, the light blocking flag 18*n*, which is disposed on one end of the discharging detection sensor unit shaft 18*a*, moves to overlap with an optical axis extending in the space between the light emitting portion 11*a* and the light receiving portion 11*b* of the photointerrupter 11, and thus the space is in the light blocking state. This enables the controller 14 to detect the passage of the sheet S.

In addition, when the rear end of the sheet C is discharged by the pair of discharging rollers 10 (FIG. 4D), the contact flag 18*b* starts falling in a direction indicated by the arrow Q in FIG. 4D together with the falling of the sheet A. Thus, the discharging detection sensor unit 18 is returned to the standby state indicated in FIG. 4A. If the printing further continues, as illustrated in FIG. 4E, the sheets on the sheet stacked portion. 9 prevents the contact flag 18*b* of the discharging detection sensor unit. 18 from returning to the standby state illustrated in FIG. 4A. Thus, the light blocking flag 18*n* is continuously positioned in the space between the light emitting portion 11*a* and the light receiving portion 11*b* of the photointerrupter 11, and the space is in the light blocking state.

When the controller 14 detects that the switching of the sensor state is not performed, the controller 14 determines that the sheets on the sheet stacked portion. 9 reach the stack limit. In such a case, the controller 14 stops the image forming operation. If the image forming apparatus 100 includes a status display, the controller 14 causes the status display to display that the sheets on the sheet stacked portion 9 reach the stack limit, and thus the user is informed about the status of the sheet stacked portion 9. In addition, the controller 14 informs an instruction device, which sent print instructions, that the printing is stopped because the sheets on the sheet stacked portion reached the stack limit.

In the above-described embodiment, the contact flag 18*b*, which is a contact portion in contact with the sheet S, includes the sheet surface detection portion (inclined guide surface) 18*h* to be in contact with the sheet surface (surface Sk) at an angle along the inclination of the sheet surface bent in the wave form in the width direction for stiffening. This configuration reduces a contact pressure at the sheet surface detection portion (inclined guide surface) 18*h* of the contact flag 18*b*.

In addition, the reduction in the local contact of the contact flag 18*b* with the sheet S reduces the local wear of the contact flag 18*b*. This reduces paper jam due to the local wear, leading to a longer service life of the apparatus. In addition, this reduces oblique movement of the sheet during discharging due to damage caused by the local wear, enabling the sheet to be reliably stacked onto the sheet stacked portion over all the service life of the apparatus. In addition, this reduces edge damage generated at the front end of the sheet S at the end of the service life of the contact flag 18*b* of the discharging detection sensor unit 18, for example.

Second Embodiment

Figure 5:
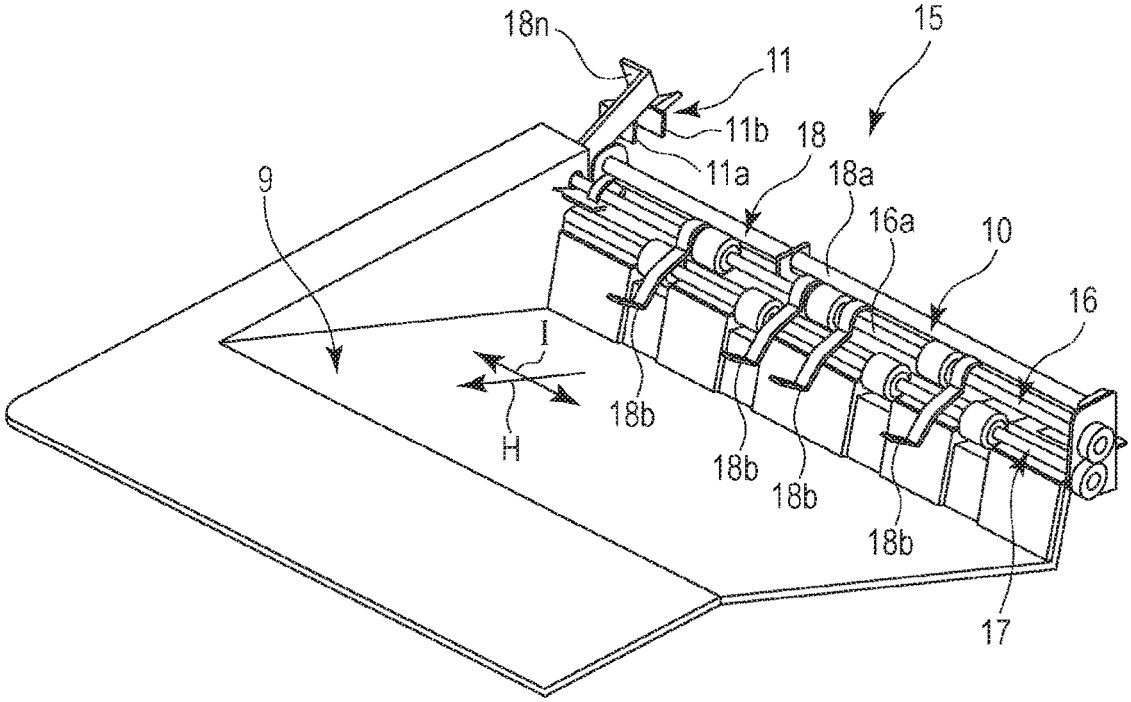
FIG. 5 is a perspective view illustrating a sheet discharging portion according to a second embodiment of the present invention.
Figure 6A:
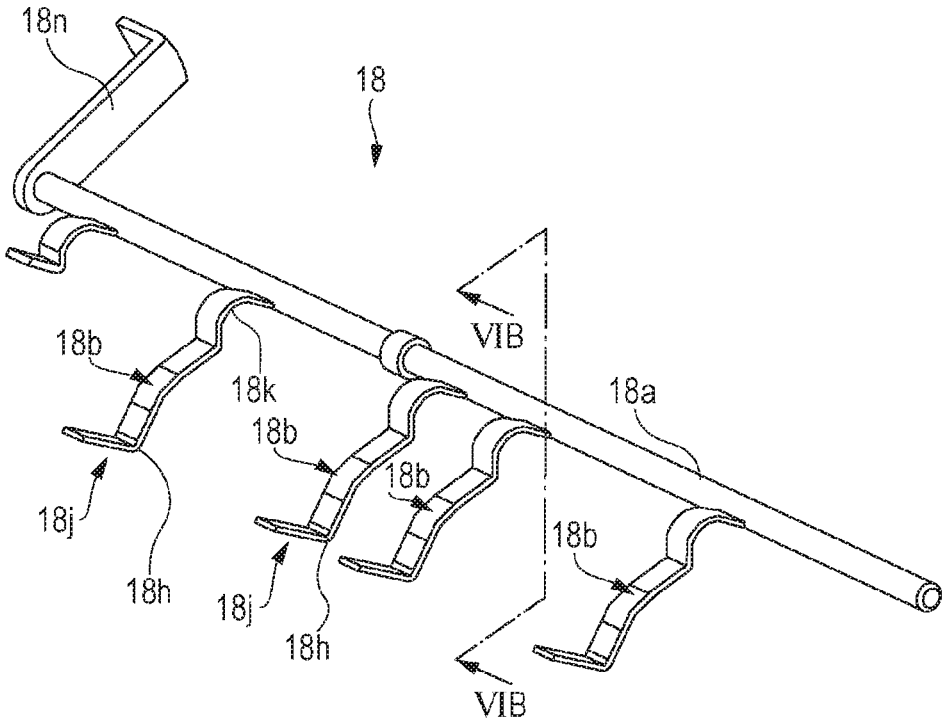
FIG. 6A is a detailed view of the discharging detection sensor unit.
Figure 6B:
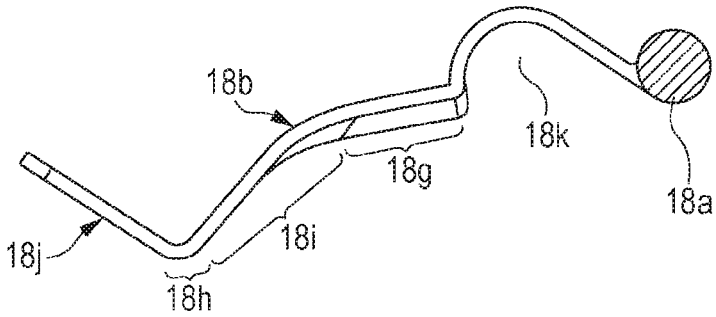
FIG. 6B is an enlarged cross-sectional view taken along line VIB-VIB in FIG. 6A and viewed in a direction indicated by arrows.

Next, a sheet discharging portion 15, which is a sheet discharging apparatus, according to a second embodiment of the present invention is described with reference to FIG. 5 and FIGS. 6A and 6B. FIG. 5 is a perspective view illustrating the sheet discharging portion 15 according to the present embodiment. FIG. 6A is a view illustrating a discharging detection sensor unit 18 in detail. FIG. 6B is a cross-sectional magnified view taken along line VIB-VIB in FIG. 6A and viewed in a direction indicated by arrows. In this embodiment, components corresponding to those in the first embodiment are assigned the same reference numerals as those in the first embodiment, and the configurations and functions thereof are not described if they are identical to those in the first embodiment.

As in the first embodiment, the sheet discharging portion 15 of the second embodiment includes a pair of discharging rollers (discharging portion) 10 including an upper discharging roller 16 and a lower discharging roller 17 configured to discharge a sheet from the apparatus body 100*a*. In addition, a discharging detection sensor unit 18, which is configured to detect that the sheet is discharged from the apparatus by the pair of discharging rollers 10, is disposed near the pair of discharging rollers 10. The sheet discharged from the apparatus is sequentially stacked on the sheet stacked portion 9.

FIG. 6A illustrates the discharging detection sensor unit 18 in detail. As illustrated in FIG. 6A, the discharging detection sensor unit 18 includes a discharging detection sensor unit shaft 18*a* rotatably supported at its each end, a plurality of contact flags 18*b* (four contact flags 18 in this embodiment), and a light blocking flag 18*n* integrally formed with the discharging detection sensor unit shaft 18*a*. The contact flags 18*b* are each fixed to the discharging detection sensor unit shaft 18*a*, which is a base portion, at an end opposite to a free end portion 18*j*. The light blocking flag 18*n* is configured to block the light in the photointerrupter 11, enabling the detection of the passage of the sheet. A reference numeral 18*k* in FIG. 6A and FIG. 6B denotes a curved portion of each contact flag 18*b*. The curved portion 18*k* of each contact flag 18*b* is positioned over the first rotation shaft 16*a* while the discharging detection sensor unit shaft 18*a* is disposed near the pair of discharging rollers 10, such that the free end portion 18*j* is located adjacent to the stacked portion 9 (see FIGS. 4A to 4E).

As illustrated in FIG. 6B, the contact flags 18*b* each include a first connection portion (tapered portion) 18*g*, which is an inclined guide surface according to this embodiment, at a lower surface. A sheet discharged from the apparatus comes in contact with the first connection portion 18*g* at first. The lower surface of each contact flag 18*b* further includes a sheet surface detection portion 18*h*, which is configured to detect the sheet on the stacked portion, in the free end portion 18*j* and a second connection portion 18*i* connecting the sheet surface detection portion 18*h* with the first connection portion 18*g*. In other words, the contact flag 18*b* includes the first connection portion 18*g* as the inclined guide surface inclined at an angle along the inclination of the surface Sk (FIG. 3A), which is bent in the wave form in the width direction (indicated by the arrow I in FIG. 5), of the sheet, which is bent in the wave form for stiffening and discharged by the pair of discharging rollers 10, and the second connection portion 18*i*.

In this embodiment, the first connection portion 18*g* includes the inclined guide surface (tapered portion), which corresponds to the sheet surface detection portion 18*h* in the contact flag 18*b* of the first embodiment. In this embodiment, a tangent line of the sheet surface detection portion 18*h* to the surface of the sheet extends linearly in substantially parallel to the discharging detection sensor unit shaft 18*a*. In addition, the second connection portion 18*i* is a connection surface smoothly connecting the first connection portion 18*g* with the sheet surface detection portion 18*h*. In other words, in the contact flag 18*b* of the present embodiment, the free end portion 18*j* comes in contact with the sheet discharged by the pair of discharging rollers 10 while the discharging detection sensor unit shaft 18*a* as the base portion is rotatably supported by the apparatus body 100*a*. In addition, the first connection portion 18*g* as the inclined guide surface is provided between the free end portion 18*j* and the discharging detection sensor unit shaft 18*a*.

With the above-described configuration of the present embodiment, the first connection portion 18*g* as the inclined guide surface prevents the contact flag 18*b* from having abnormal wear. In addition, since the sheet surface detection portion 18*h* extends substantially parallel to the discharging detection sensor unit shaft 18*a*, the sheet surface detection portion 18*h* extends linearly in a direction substantially perpendicular to the sheet delivery direction. This shortens time required for the rear end of the sheet to pass through the discharging detection sensor unit 18, and thus shortens the waiting time required for the next sheet. Thus, this configuration is applicable to an image forming apparatus 100 in which an image is formed at a higher speed.

In the first embodiment, the sheet surface detection portion 18*h* included in the free end portion 18*j* of the contact flag 18*b* includes the inclined guide surface. In the second embodiment, the inclined guide surface is provided between the free end portion 18*j* and the discharging detection sensor unit shaft 18*a*. However, the contact flag 18*b* may include both the inclined guide surface at the sheet surface detection portion 18*h* and the inclined guide surface at the position between the free end portion 18*j* and the discharging detection sensor unit shaft 18*a*. Such a configuration provides advantages substantially same as those described above. This configuration is applicable to third and fourth embodiments described later.

Third Embodiment

Figure 7:
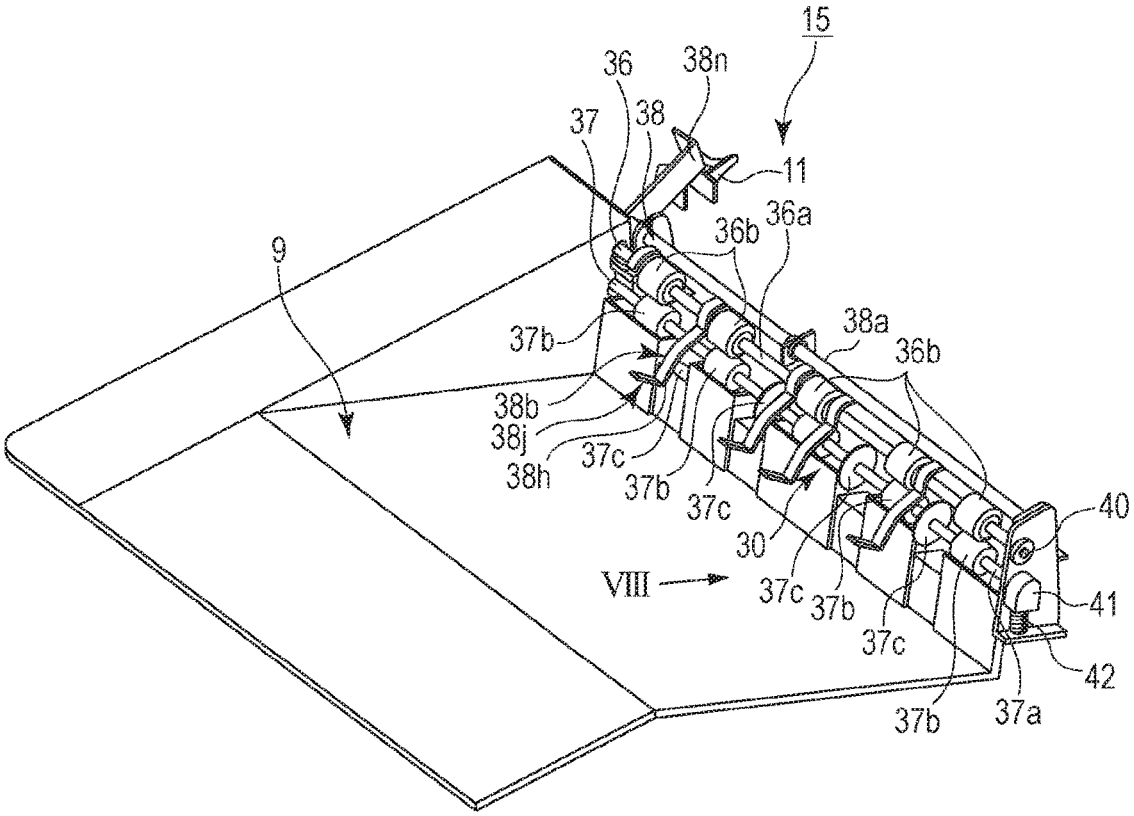
FIG. 7 is a perspective view illustrating a sheet discharging portion according to a third embodiment of the present invention.
Figure 8:
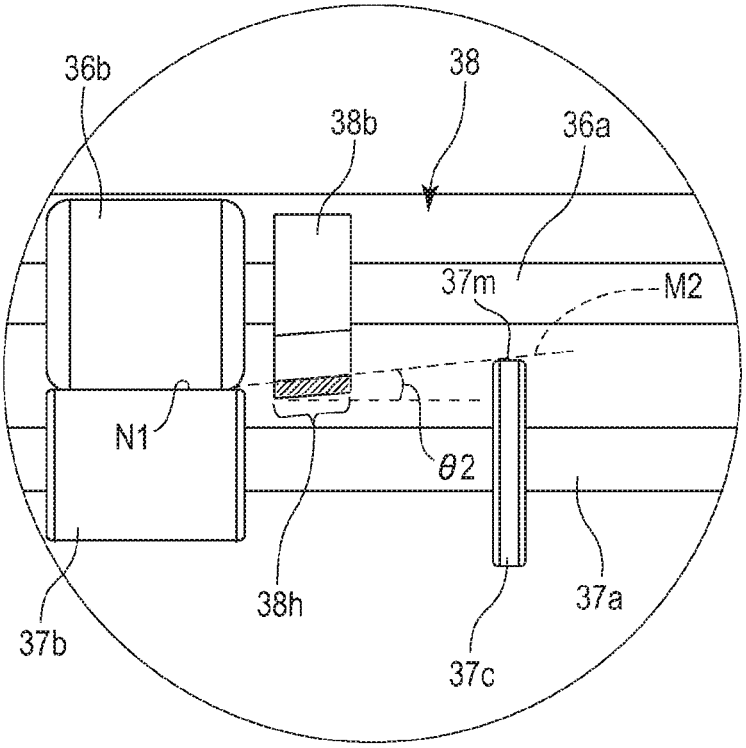
FIG. 8 is a magnified view of a portion in FIG. 7.

Next, a sheet discharging portion 15, which is a sheet discharging apparatus, according to a third embodiment of the present invention is described with reference to FIG. 7 and FIG. 8. FIG. 7 is a perspective view illustrating the sheet discharging portion 15 according to the present embodiment. FIG. 8 is a view of a portion of the sheet discharging portion 15 viewed in a direction indicated by the arrow VIII in FIG. 7. In this embodiment, components corresponding to those in the first embodiment are assigned the same reference numerals as those in the first embodiment, and the configurations and the functions thereof are not described if they are identical to those in the first embodiment.

In the third embodiment and a fourth embodiment, which is described later, the first and second discharging roller bodies are not arranged alternately in the comb like arrangement as in the first and second embodiments, but the first and second discharging roller bodies face each other and form a nip portion. In the third and fourth embodiments, a sheet surface detection portion 38*h* included in a free end portion 38*j* of a contact flag 38*b* includes the inclined guide surface. However, as in the above-described second embodiment, the inclined guide surface may be provided at the position between the free end portion 38*j* and a shaft (base portion) 38*a*.

As illustrated in FIG. 7, the sheet discharging portion 15 according to the present embodiment includes a pair of discharging rollers (discharging portion) 30 configured to discharge a sheet from the apparatus body 100*a* (see FIG. 1). The pair of discharging rollers 30 includes an upper discharging roller 36 and a lower discharging roller 37. The upper discharging roller 36 of the pair of discharging rollers 30 includes a first rotation shaft 36*a* rotatably supported by a bearing 40 disposed at its axial end and a plurality of first discharging roller bodies 36*b* configured to be in contact with the sheet and discharge the sheet. The lower discharging roller 37 of the pair of discharging rollers 30 includes a plurality of second discharging roller bodies 37*b* supported by a second rotation shaft 37*a* and facing corresponding one of the first discharging roller bodies 36*b*. The number of the second discharging roller bodies 37*b* is the same as the number of the first discharging roller bodies 36*b*. The lower discharging roller 37 is pressed against the upper discharging roller 36 by a compression spring 42 through a bearing 41 with a predetermined pressure while the second rotation shaft 37*a* is rotatably supported by the bearing 41.

The lower discharging roller 37 includes stiffening rollers 37*c* each having a larger outer diameter than the second discharging roller body 37*b* at positions between the second discharging roller bodies 37*b*. The stiffening rollers 37*c* positioned between the second discharging roller bodies 37*b* bend the sheet S sandwiched between the first and second discharging roller bodies 36*b* and 37*b* in the wave form for stiffening. In addition, a discharging detection sensor unit 38, which is configured to detect that the sheet is discharged from the apparatus by the pair of discharging roller 30, is disposed near the pair of discharging rollers 30. The sheet detected by the discharging detection sensor unit 38 and discharged from the apparatus is sequentially stacked on the sheet stacked portion 9.

The above-described pair of discharging rollers 30 includes at least one first discharging roller body 36*b* supported coaxially by the first rotation shaft 36*a* and at least one second discharging roller body 37*b* supported coaxially by the second rotation shaft 37*a*. The first discharging roller body 36*b* and the second discharging roller body 37*b* face the front surface and the rear surface of the sheet to be discharged, respectively. The first discharging roller body 36*b* and the second discharging roller body 37*b* are located at the same position in the width direction (indicated by the arrow I in FIG. 5) so as to face and be pressed against each other. In addition, the pair of discharging rollers 30 includes the stiffening rollers 37*c* supported by the second rotation shaft 37*a* so as to face a space between the adjacent first discharging roller bodies 36*b*. The stiffening roller 37*c* has a larger diameter than the second discharging roller body 37*b*.

The stiffening roller 37*c* may be positioned differently from the above-described configuration. Specifically, the stiffening roller 37*c* having a larger diameter than the first discharging roller body 36*b* may be supported by the first rotation shaft. 36*a* so as to face a space between the second discharging roller bodies 37*b*. The stiffening roller 37*c* disposed on the upper discharging roller 36, instead of the lower discharging roller 37, provides the same advantages as the stiffening roller 37*c* disposed on the lower discharging roller 37.

As illustrated in FIG. 8, the inclined guide surface of the sheet surface detection portion 38*h* at the position near the nip portion N1 of the pair of discharging rollers 30 has the configuration described below. The inclined guide surface 38*h* is inclined at an angle θ2 so as to extend along a straight line M2 connecting an end adjacent to the stiffening roller 37*c* of the nip portion N1, which is provided between the opposed first and second discharging roller bodies 36*b* and 37*b*, with an outer peripheral surface 37*m* of the stiffening roller 37*c*. The nip portion N1 and the outer peripheral surface 37*m* are adjacent to each other in the width direction in a space between the first and second rotation shafts 36*a* and 37*a*.

In the above-described embodiment, the present invention is applicable to a discharging portion including a transportation system configured to grip the sheet firmly at the front and rear surfaces of the sheet and a stiffening roller. In other words, the sheet surface detection portion 38*h* inclined at the angle θ2 reduces the abnormal wear of the contact flag (contact member) 38*b* without using a material having high wearing resistance or using an additional high polymer sheet having low friction coefficient.

Fourth Embodiment

Figure 9:
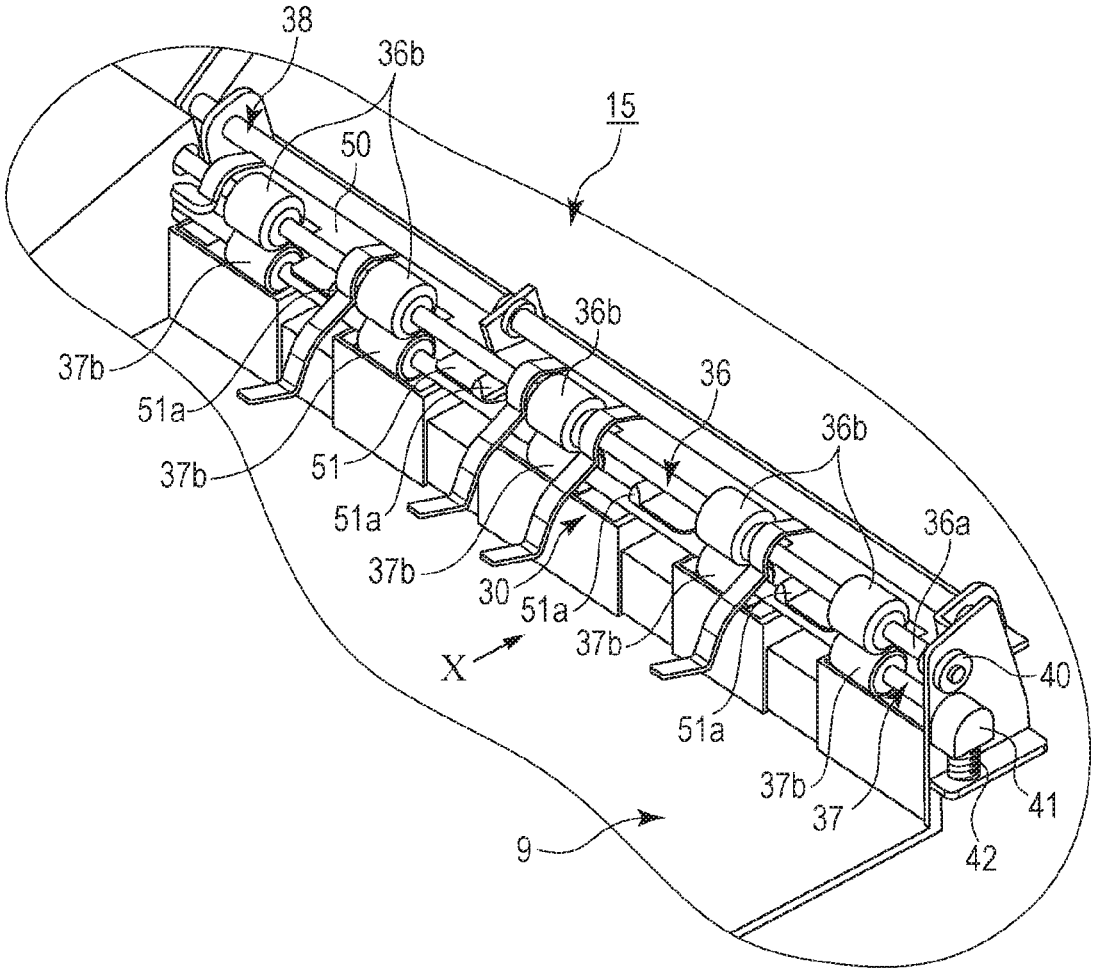
FIG. 9 is a perspective view illustrating a sheet discharging portion according to a fourth embodiment of the present invention.
Figure 10:
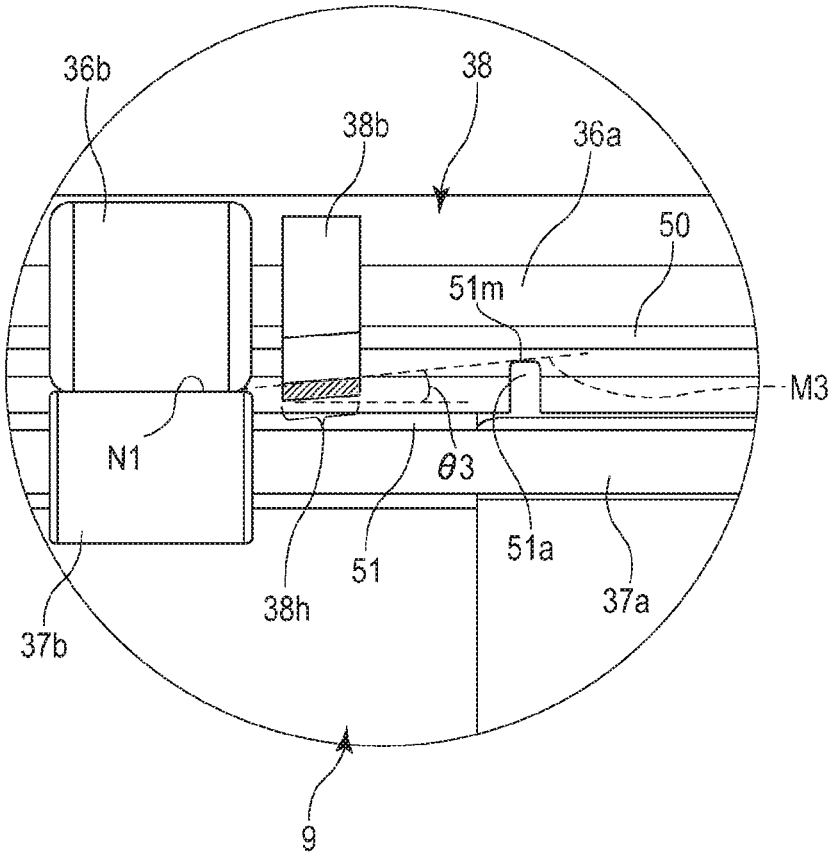
FIG. 10 is a magnified view of a portion in FIG. 9.

Next, a sheet discharging portion 15, which is a sheet discharging apparatus, according to a fourth embodiment of the present invention is described with reference to FIG. 9 and FIG. 10. FIG. 9 is a perspective view illustrating the sheet discharging portion 15 according to the present embodiment. FIG. 10 is a view illustrating a portion of the sheet discharging portion 15 according to the present embodiment viewed in a direction indicated by the arrow X in FIG. 9. In the present embodiment, components corresponding to those in the first embodiment are assigned the same reference numerals as those in the first embodiment, and the configurations and functions thereof are not described if they are identical to those in the first embodiment.

As illustrated in FIG. 9, the sheet discharging portion 15 according to the present embodiment includes a pair of discharging rollers (discharging portion) 30 configured to discharge the sheet from the apparatus body 100*a* (see FIG. 1). The pair of discharging rollers 30 includes an upper discharging roller 36 and a lower discharging roller 37. The upper discharging roller 36 of the pair of discharging rollers 30 includes a first rotation shaft 36*a* rotatably supported, by a bearing 40 disposed at its axial end and a plurality of first discharging roller bodies 36*b* configured to be in contact with the sheet and discharge the sheet. The lower discharging roller 37 of the pair of discharging rollers 30 includes a plurality of second discharging roller bodies 37*b* supported by a second rotation shaft 37*a* (FIG. 10) and facing corresponding one of the first discharging roller bodies 36*b*. The number of the second discharging roller bodies 37*b* is the same as the number of the first discharging roller bodies 36*b*. The lower discharging roller 37 is pressed against the upper discharging roller 36 with a predetermined pressure by a compression spring 42 through a bearing 41 while the second rotation shaft 37*a* is rotatably supported by the bearing 41.

In the lower discharging roller 37, stiffening ribs (stiffening protrusions) 51*a* each protruding beyond an outer peripheral surface of the second discharging roller body 37*b* are disposed between the second discharging roller bodies 37*b*. The stiffening ribs 51*a* between the second discharging roller bodies 37*b* bend the sheet S, which is sandwiched between the first and second discharging roller bodies 36*b* and 37*b*, in the wave form for stiffening. In addition, a discharging detection sensor unit 38, which is configured to detect that the sheet is discharged from the apparatus by the pair of discharging rollers 30, is disposed near the pair of discharging rollers 30. The sheet detected by the discharging detection sensor unit 38 and discharged from the apparatus is sequentially stacked on a sheet stacked portion 9.

The above-described pair of discharging rollers 30 includes at least one first discharging roller body 36*b* supported coaxially by the first rotation shaft 36*a* and at least one second discharging roller body 37*b* supported coaxially by the second rotation shaft 37*a*. The first discharging roller body 36*b* and the second discharging roller body 37*b* face the front surface and the rear surface of the sheet to be discharged, respectively. The first discharging roller body 36*b* and the second discharging roller body 37*b* are located at the same position in the width direction (indicated by the arrow I in FIG. 5) so as to face and be pressed against each other. The pair of discharging rollers 30 further includes the stiffening rib (stiffening protrusion) 51*a* supported by the second rotation shaft 37*a* so as to face a space between the adjacent first discharging roller bodies 36*b*. The stiffening rib 51*a* protrudes beyond the outer peripheral surface of the second discharging roller body 37*b*.

The stiffening rib 51*a* may be positioned differently from the above-described configuration. Specifically, the stiffening rib 51*a* protruding beyond the outer peripheral surface of the first discharging roller body 36*b* may be supported by the first rotation shaft 36*a* so as to face a space between the adjacent second discharging roller bodies 37*b*. In this embodiment, the stiffening rib 51*a* is disposed on a lower discharging guide 51, but the position of the stiffening rib 51*a* is not limited thereto. The stiffening rib 51*a* may be disposed on an upper discharging guide 50. As described above, the stiffening rib 51*a* disposed on the upper discharging roller 36, instead of the lower discharging roller 37, provides the same advantages as those described above.

As illustrated in FIG. 10, the inclined guide surface on the sheet surface detection portion 38*h* near the nip portion N1 of the pair of discharging rollers 30 has the configuration described below. The inclined guide surface is inclined at an angle θ3 so as to extend along a straight line M3 connecting an end adjacent to the stiffening rib 51*a* of the nip portion N1, which is provided between the opposed first and second discharging roller bodies 36*b* and 37*b*, with a front surface 51*m* of the stiffening rib 51*a*. The nip portion N1 and the stiffening rib 51*a* are adjacent to each other in the width direction in a space between the first and second rotation shafts 36*a* and 37*a*.

In the above-described embodiment, the present invention is applicable to a discharging portion including a transportation system configured to grip the sheet firmly at the front and rear surfaces of the sheet and a stiffening rib. In other words, the sheet surface detection portion 38*h* inclined at the angle θ3 reduces the abnormal wear of the contact flag (contact member) 38*b* without using a material having high wearing resistance or using an additional high polymer sheet having low friction coefficient.

In this embodiment, the stiffening rib 51*a* is used as a stiffening protrusion, but the shape of the stiffening protrusion is not limited. The stiffening protrusion may have any protruded shape inclined along the inclined guide surface, which is positioned near the nip portion N1 of the pair of discharging rollers 30, and the straight line M3 so as to bend the sheet. In addition, a stiffening member may be provided as a separate member. The stiffening member may be configured to be retracted by contact of a sheet having high strength.

In this embodiment, the image forming apparatus 100 using an electrophotography process is described. However, the present embodiment may be applied to an image forming apparatus using an inkjet process in which ink droplets are discharged from nozzles to form an image on a sheet, for example, instead of the image forming apparatus 100 using an electrophotography process.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-206278, filed Oct. 20, 2015, which is hereby incorporated by reference herein in its entirety.

What is claimed is:

1. A sheet discharging apparatus configured to discharge a sheet, the sheet discharging apparatus comprising:

a discharging portion configured to discharge a sheet so that the sheet is bent in a curved shape in a width direction of the sheet perpendicular to a discharging direction of the sheet when viewed in a sheet discharging direction;

a contact member configured to be moved by contact with the sheet discharged by the discharging portion, wherein the contact member includes a first contact surface to be in contact with an edge of the sheet and a second contact surface to be in contact with a surface of the sheet, wherein the first contact surface is not in contact with the discharging portion, wherein the first contact surface faces the discharging portion in a state where the first contact surface is not in contact with the sheet, wherein the first contact surface is inclined along the curved shape of the sheet in the width direction of the sheet when viewed in the sheet discharging direction, and wherein the second contact surface is inclined along the curved shape of the sheet in the width direction of the sheet when viewed in the sheet discharging direction; and a detector configured to detect a discharging of the sheet based on the movement of the contact member.

2. The sheet discharging apparatus according to claim 1, further comprising a stacked portion on which the sheet discharged by the discharging portion is stacked, wherein the detector is configured to detect, based on the movement of the contact member, that sheets on the stacked portion reach a stack limit.

3. The sheet discharging apparatus according to claim 1, wherein the discharging portion includes a first discharging roller and a second discharging roller.

4. The sheet discharging apparatus according to claim 3, wherein the first discharging roller includes a first rotation shaft and a plurality of first bodies configured to rotate together with the first rotation shaft.

5. The sheet discharging apparatus according to claim 4, wherein the second discharging roller includes a second rotation shaft and a plurality of second bodies configured to rotate together with the second rotation shaft.

6. The sheet discharging apparatus according to claim 5, wherein the first rotation shaft and the second rotation shaft face each other.

7. The sheet discharging apparatus according to claim 6, wherein the sheet passing through the discharging portion is discharged while being in a wave form in the width direction along arrangement of the plurality of first bodies and the plurality of second bodies.

8. The sheet discharging apparatus according to claim 5, wherein the plurality of first bodies and the plurality of second bodies are arranged alternately and not in contact with each other.

9. The sheet discharging apparatus according to claim 5, wherein, when viewed in the sheet discharging direction, the contact member is located between the plurality of first bodies and the plurality of second bodies adjacent to each other in the width direction.

10. The sheet discharging apparatus according to claim 5, wherein, the contact member includes the first contact surface and the second contact surface such that the sheet discharged from the discharge portion contacts the first contact surface and then contacts the second contact surface.

* * * * *